US006568479B2

(12) United States Patent
Mosing et al.

(10) Patent No.: US 6,568,479 B2
(45) Date of Patent: May 27, 2003

(54) HORSESHOE SHAPED ELEVATOR AND METHOD FOR USING SAME

(75) Inventors: Donald E. Mosing, Lafayette, LA (US); David L. Sipos, Youngsville, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/999,344

(22) Filed: Nov. 15, 2001

(65) Prior Publication Data

US 2002/0033277 A1 Mar. 21, 2002

Related U.S. Application Data

(63) Continuation-in-part of application No. 09/410,706, filed on Oct. 1, 1999.

(51) Int. Cl.[7] ..... E21B 19/14; E21B 19/18

(52) U.S. Cl. ..... 166/380; 166/77.52; 285/86.31; 285/90; 285/102.2

(58) Field of Search ..... 166/378, 380, 166/77.51, 77.52; 175/52, 85; 294/86.1, 86.26, 86.3, 86.31, 86.32, 88, 90, 91, 102.1, 102.2, 103.1

(56) References Cited

U.S. PATENT DOCUMENTS

| | | | | | |
|---|---|---|---|---|---|
| 1,211,999 | A | * | 1/1917 | Arey et al. | 294/91 |
| 1,535,625 | A | * | 4/1925 | O'Bannon | 292/52 |
| 1,548,337 | A | * | 8/1925 | Smith | 294/91 |
| 1,754,288 | A | * | 4/1930 | Smith | 294/91 |
| 1,766,920 | A | * | 6/1930 | Moody | 294/91 |
| 1,774,675 | A | * | 9/1930 | Smith | 294/91 |
| 2,009,942 | A | * | 7/1935 | Moody | 294/91 |
| 3,825,129 | A | * | 7/1974 | Beck | 212/72 |
| 4,042,123 | A | * | 8/1977 | Sheldon et al. | 175/85 |
| 4,269,554 | A | * | 5/1981 | Jackson | 294/102.2 |
| 4,441,749 | A | * | 4/1984 | Blaschke et al. | 294/88 |
| 4,604,724 | A | * | 8/1986 | Shaginian et al. | 166/53 |
| 4,647,099 | A | * | 3/1987 | Berry et al. | 294/103.1 |
| 5,127,790 | A | * | 7/1992 | Teague | 414/22.51 |
| 5,299,848 | A | * | 4/1994 | Boyer | 294/106 |
| 5,340,182 | A | * | 8/1994 | Busink et al. | 294/102.2 |

* cited by examiner

*Primary Examiner*—David Bagnell
*Assistant Examiner*—Jennifer H Gay
(74) *Attorney, Agent, or Firm*—William E. Johnson, Jr.; The Matthews Firm

(57) ABSTRACT

A U-shaped elevator having no doors is provided with first and second latching mechanisms which when contacted by the tubular to be entrapped within the elevator move from a closed position to an open position and which then return to a closed position as soon as the tubular is entrapped within the elevator. The latching mechanisms have a safety catch which prevents the tubular from being inadvertently removed from the elevator. The safety latch mechanism can only be activated by a handle which is manipulated by hand by personnel working on the derrick utilizing the elevator. The elevator has an open throat to receive tubulars that have couplers or other features with a lower flange surface for lifting a pipe string. The throat access has blocking members that are movable to allow tubulars to move out of the gap unless the blocking members are locked to prevent such movement. The blocking members have latches biased toward a position to immobilize the members. To allow tubulars to exit the throat, an unlocking mechanism is actuated manually or by motorized means under remote control.

49 Claims, 7 Drawing Sheets

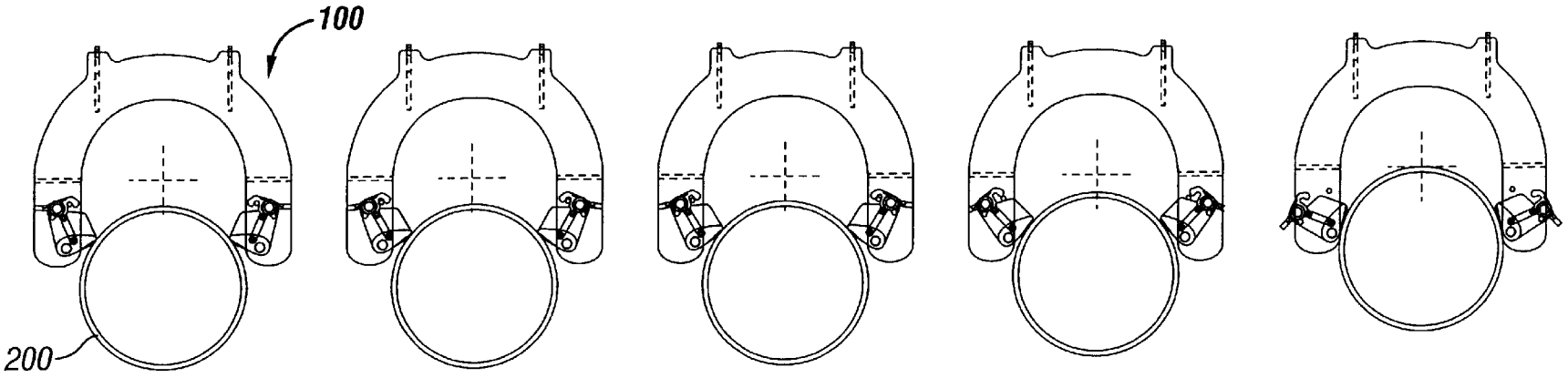
FIG. 5A
FIG. 5B
FIG. 5C
FIG. 5D
FIG. 5E
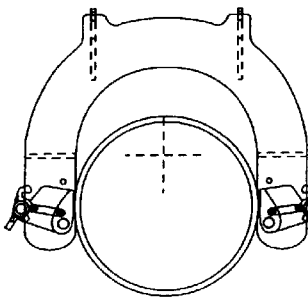
FIG. 5F
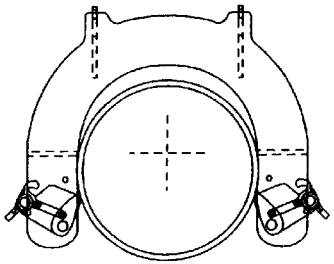
FIG. 5G
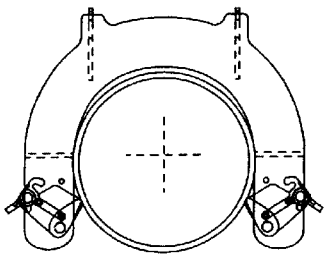
FIG. 5H
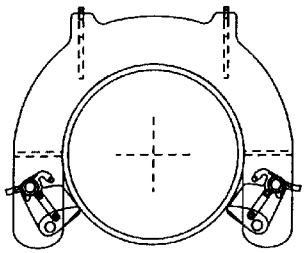
FIG. 5I
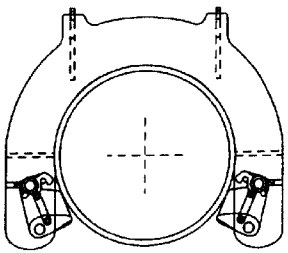
FIG. 5J

HORSESHOE SHAPED ELEVATOR AND METHOD FOR USING SAME

RELATED APPLICATION

This application is a continuation-in-part of U.S patent application Ser. No. 09/410,706, filed Oct. 1, 1999.

FIELD OF INVENTION

The invention relates, generally, to pipe handling elevators used for lifting and lowering oilfield tubulars, usually as strings of pipe being tripped into or out of an oil or gas well.

BACKGROUND OF THE INVENTION

It is well known in the art of drilling, completion and workover of earth boreholes in the oil, gas and geothermal industries to run strings of oilfield tubulars into and out of such boreholes, sometimes referred to as "tripping in" or "tripping out". Such tubulars can be, for example, drill pipe, drill collars, casing and tubing. It is also well known to use elevators in such tripping in or out operations to lift or lower such tubulars out of, or into the wells. The handling gear for such tubulars is oftentimes much alike in principle for all sizes but the difference in scale is impressive. Well casing with a diameter of six feet, with a two inch wall thickness, is not uncommon.

Elevators in the prior art typically are hinged, heavy clamps attached to a hook and traveling block by bail-like arms, sometimes referred to simply as "bails". Such elevators oftentimes use one or more doors which are themselves quite heavy, and which may require two or three strong men to close or hinge the one or two doors around the tubular. Doors are a common feature but there are single door and split door types. One type simply hinges to open to admit or eject pipe. In hoisting a joint of drill pipe, the elevators are latched onto the pipe just below the tool joint (coupling) which prevents the drill pipe from slipping through the elevators. Similarly, in lifting casing or tubing, the sections of such tubulars have either an upset end, i.e., one in which the O.D. is larger than the primary diameter of the casing or tubing, or they are joined together with a collar having an enlarged O.D. In all of these type of operations, the elevator when hinged to the closed position, i.e., when the one or two doors are closed shut, the internal diameter of the elevator is less than the O.D. of the end of the enlarged tool joint, upset, or collar to prevent the tubular from slipping through the elevator.

Handling practices differ between small and rather large diameter pipe. Each section of very large pipe will typically be picked up from the horizontal position and swung to the vertical for stabbing into the connection of the assembled tubular string. Such large pipe, for example, large diameter steel casing, presents special problems. When elevators are placed on the horizontal pipe they have to pivot to orient the elevator throat opening downward. That leaves the doors, on door-type elevators, swinging on hinges. The doors on a large elevator may weigh several hundred pounds. To close such doors, drilling crew men place themselves in hazardous situations. The rigging devised to get the doors closed often is creative, but risky.

An elevator with doors needs clearance for the doors to swing in the closing arc under the pipe being engaged. The pipe has to be elevated, or clearance otherwise provided, for the swinging door.

The elevators discussed above are of the so-called "non-slip" variety. There are other elevators which grasp the tubular and can be used to then hoist or lower the tubular, but the grasping elevators are typically used with the light weight tubulars.

The elevators of the "non-slip" variety have generally been constructed with doors (generally, one or two) which open to allow the insertion or removal of the tubulars. These doors have traditionally been heavy, slow in operation, difficult to handle and present a considerable safety hazard to the operator. Also, the balance point of the elevator will change dramatically when the doors are opened, thus exacerbating handling problems and adding danger to the operator.

Especially with very heavy tubulars, for example, 20"–30" casing, the tubular is initially in a horizontal position, laying in place, for example, on or near the floor beneath a derrick, and the hinged door elevator is lowered near the point of attachment to the tubular. The derrick hands then are required to open the very heavy door or doors, which may weigh several hundred pounds, to allow the elevator to be placed over the tubular. Moreover, because the door or doors must close around the tubular, the tubular end around which the elevator is placed must be above the derrick floor.

SUMMARY OF THE INVENTION

The present invention avoids the above mentioned shortcomings by eliminating the troublesome door members. Retention of the pipe is then accomplished by a system of multiple pipe catches, which are automatically deployed after the insertion of the pipe joint and which automatically retract during insertion of a pipe joint. Importantly, since this elevator lacks swinging doors, the element of the greatest safety concern is eliminated and, the equilibrium of the elevator is undisturbed during insertion or removal of pipe.

When a tubular approaches the elevator, according to the present invention, the tubular first contacts the disconnector arms. As insertion continues, the disconnector arms are swung away in an arc-like path and this motion actuates the disconnector links which disengage the safety latches, allowing the pipe catches freedom to move. The continuing movement of the pipe into the elevator next causes the pipe to contact the pipe catches directly and pushes them out of the way against a nominal spring force. After the pipe is fully seated into the elevator, the pipe catches (no longer restrained by the pipe body) will automatically deploy by means of spring power. The pipe is now mechanically entrapped and cannot fall out of the elevator. As a function of the mechanism's geometry, the greater the force from the pipe resting against the catches, the greater will be the resistance to opening. The pipe catches, in effect, become self-energizing. In fact, it will not be possible to manually open the elevator if a side force against the catches is present. This feature is an additional safety benefit.

In practicing the methods according to the present invention, elevators can be dropped or lowered onto a horizontal tubular, or swung against a vertical tubular to latch around the tubular, thus by avoiding all or most of the problems associated with using hinged door elevators.

The present invention comprises a horseshoe, or "U" shaped body having first and second extending arms separated by a throat to accept a pipe or other tubular. On each arm a blocking member imposes into the passage to and from the throat and either blocking member will prevent pipe (within the elevator rating size) from moving out of the throat of the elevator. The blocking member is spring biased to the blocking, or closed state. In the closed state, a spring biased security lock goes to the locked state, and the blocking member is immobilized in the closed state. There are two ways to free the blocking member. One way is for pipe to be urged toward the throat where it engages an enabling lever which lifts the security lock and frees the blocking member to move to admit pipe to the throat. The second way to manipulate the blocking member is to activate a dumping lever which lifts the security lock and moves further to move the blocking member away from the throat to permit pipe to move out of the throat.

The elevator has no structure that prevents the elevator from engaging pipe lying on a rig floor. The elevator freely pivots within the loops of bails which engage ears, one on each side of the body.

Not all elevators are suspended from the traveling blocks by bails, the term used herein represents any of the many contrivances serving the equivalent function in suspending elevators from traveling blocks or the equivalent hoisting apparatus.

In the preferred embodiment, and as a special feature of the invention, the ears are positioned such that the lift vector, originating at the transverse line about which the ears rotate within the bail loops, passes some distance from the centerline of pipe, when positioned for lifting, within the throat. With an open throat, the periphery of the ledge that engages the lifting surface of the pipe, normally the lower surface of a connector, represents an area that has a geometric center shifted toward the back of the throat. Ideally, but not in a limiting sense, the extended lift vector passes through, or near that geometric center.

These and other objects, advantages, and features of this invention will be apparent to those skilled in the art from a consideration of this specification, including the attached claims and appended drawings.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 5 is a series of top plan, sequential views of the elevator according to the invention, illustrating the manner in which the tubular is trapped inside the elevator;

DETAILED DESCRIPTION OF THE PREFERRED EMBODIMENT

Figure 1A:
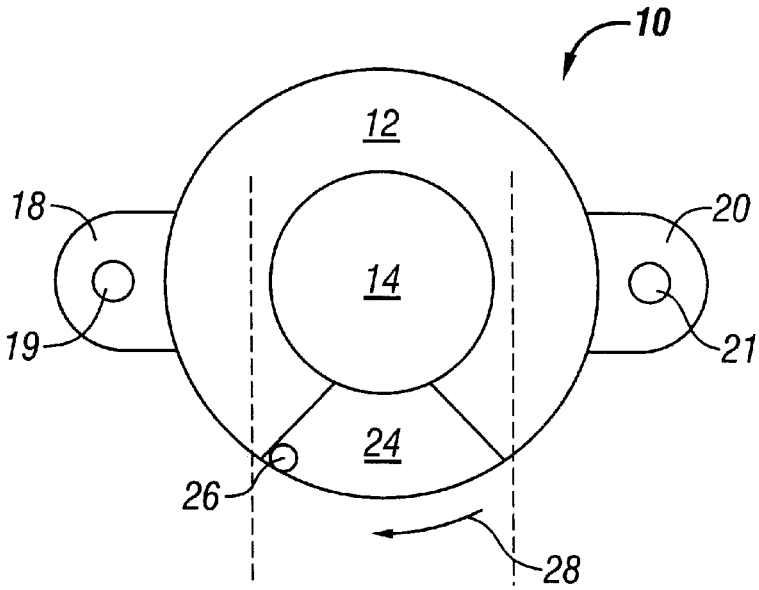
FIG. 1A (Prior Art)
FIG. 1 is a diagrammatic view of a prior art, oilfield tubular elevator.
Figure 1B:
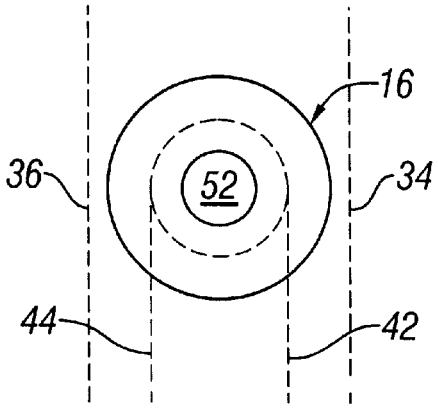
FIG. 1B (Prior Art)
Figure 1C:
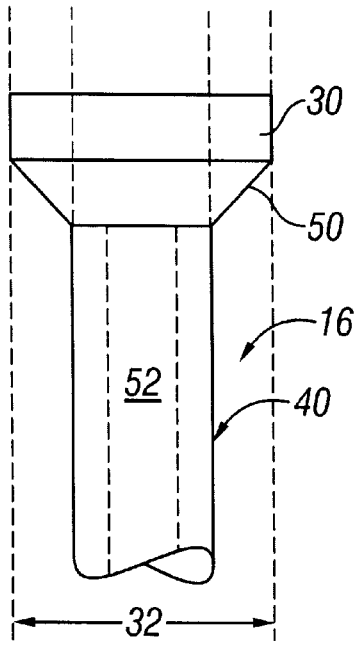
FIG. 1C (Prior Art)

Referring now to the drawings in more detail, FIG. 1(*a*) illustrates a top plan view of a hinged door elevator which is commonly used in the prior art. The prior art elevator 10 has a donut shaped body 12, having a center orifice 14 for encircling a tubular 16 such as is illustrated in FIG. 1(*c*). The elevator 10 has a pair of ears 18 and 20 having holes 19 and 21, respectively, to which the bales (not illustrated) can be attached. The elevator 10 is quite thick, for example, 8 to 10 inches thick, to have the required strength for picking up tubular strings such as large well casing which weigh in the hundreds of thousands of pounds. The elevator 10 has a door 24 which is made to rotate about a pivot pin 26 to open or close the door 24. As illustrated, the door 24 is in the closed position and is latched to the remainder of the elevator 10 to secure it into position. When the door 24 is to be opened to allow a tubular within the orifice 14 to be released, the door 24 is unlatched and pivoted around the pivot pin 26 as shown by the rotational arrow 28.

FIGS. 1(*b*) and 1(*c*), respectively, illustrate atop plan view of a tubular 16 to be entrapped within the elevator 10 and an elevated, partial view of the tubular 16. The tubular 16 has an upset, enlarged end portion 30 having an outside diameter 32 as measured between the two lines 34 and 36. The tubular 16 also has a primary section 40 below the upset portion 30 which has a reduced diameter as measured between the two lines 42 and 44. The portion 40 of the tubular is sized to fit within the interior orifice 14 of the elevator 10 as illustrated in FIG. 1(*a*). Whenever the door 24 is opened, the elevator 10 fits around the tubular 16 at a point along the tapered surface 50 of the tubular 16. As is well known in the art, the tubular 16 also includes a passage 52 along its length for allowing drilling fluid or other fluids to pass therethrough when the tubular is in an earth borehole (not illustrated).

In the operation of using the prior art elevator illustrated in FIG. 1, when it is desired to have the elevator 10 latch onto the tubular 16, whether from the horizontal or vertical positions, the door 24 has to be opened to allow the remainder of the elevator 10 to latch onto the tubular 16 at a point just beneath the upset portion 30. It should be appreciated that when the tubular is very heavy, for example 20" to 30" heavy steel casing, the elevator 10 is quite large, weighing several hundred pounds, and it requires a great amount of human effort and exposure to safety hazards to open the door 24 and engage the tubular 16 with the elevator 10.

It should be appreciated that although FIG. 1(*a*) illustrates a prior art elevator having a single door which pivots around a pivot pin 26, the prior art also includes a pair of doors (not illustrated) which together accomplish somewhat the same function as the door 24, but which are each only half the weight of a single door to allow the two doors to be opened and closed manually easier than a single door.

Figure 2A:
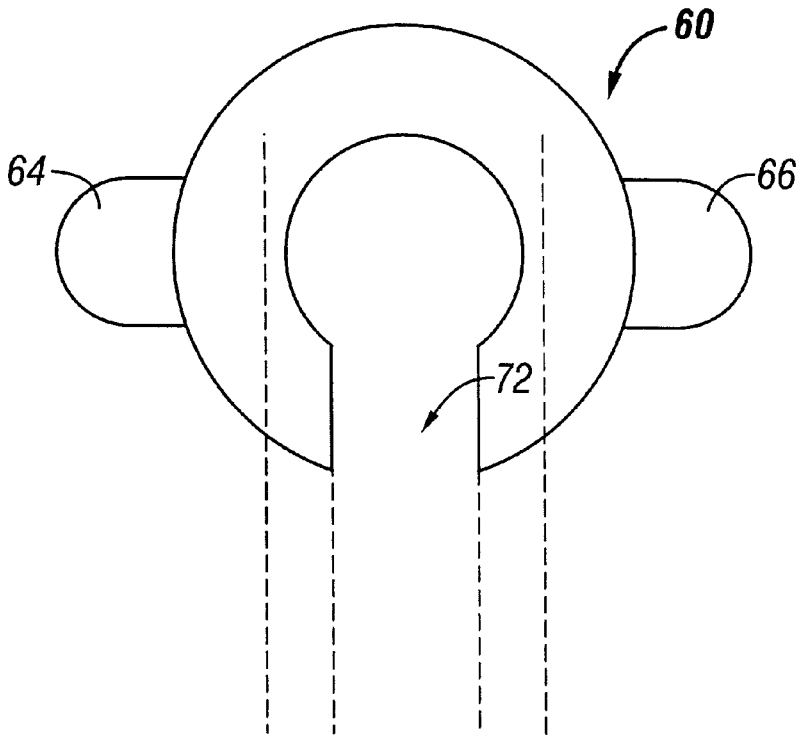
FIG. 2A (Prior Art)
FIG. 2 is a diagrammatic view of a second prior art, oilfield tubular elevator.
Figure 2B:
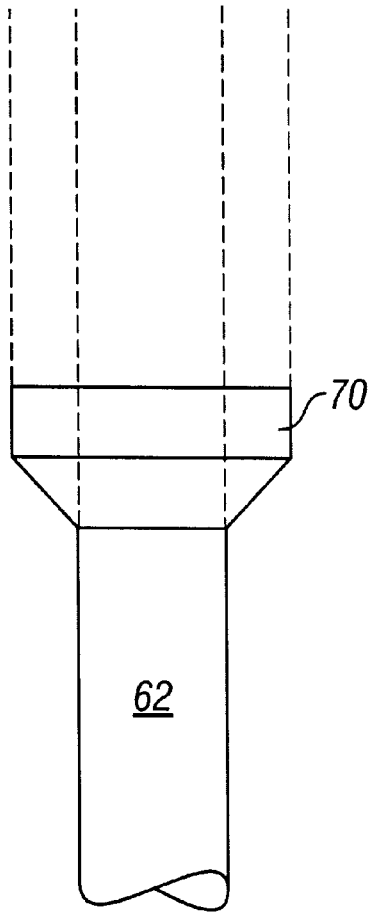
FIG. 2B (Prior Art)

Referring now to FIG. 2, there is illustrated another type of prior art elevator 60 which has no doors, but which depends upon the weight of the tubular being hoisted or lowered to maintain the tubular within the interior of the elevator 60. This type of elevator 60 is typically used by those in the prior art to raise or lower much more light weight types of downhole pipe, such as solid sucker rods, hollow sucker rods and light weight tubing. Elevator 60 has a pair of attachment rods 64 and 66 around which bales can be pivoted thereabouts, allowing the bales to be attached to a hook and traveling block as discussed above with respect to the prior art elevator of FIG. 1.

The light weight tubular 62 of FIG. 2 has an upset end 70 sized to ride on the top of the elevator 60 while the primary portion of the tubular 62 below the upset end portion 70 is sized to fit through the side opening 72 of the elevator 60.

This type of elevator is normally not used to handle the very heavy tubulars because of not having a means of entrapping the tubular within the elevator in a secure manner.

Figure 3:
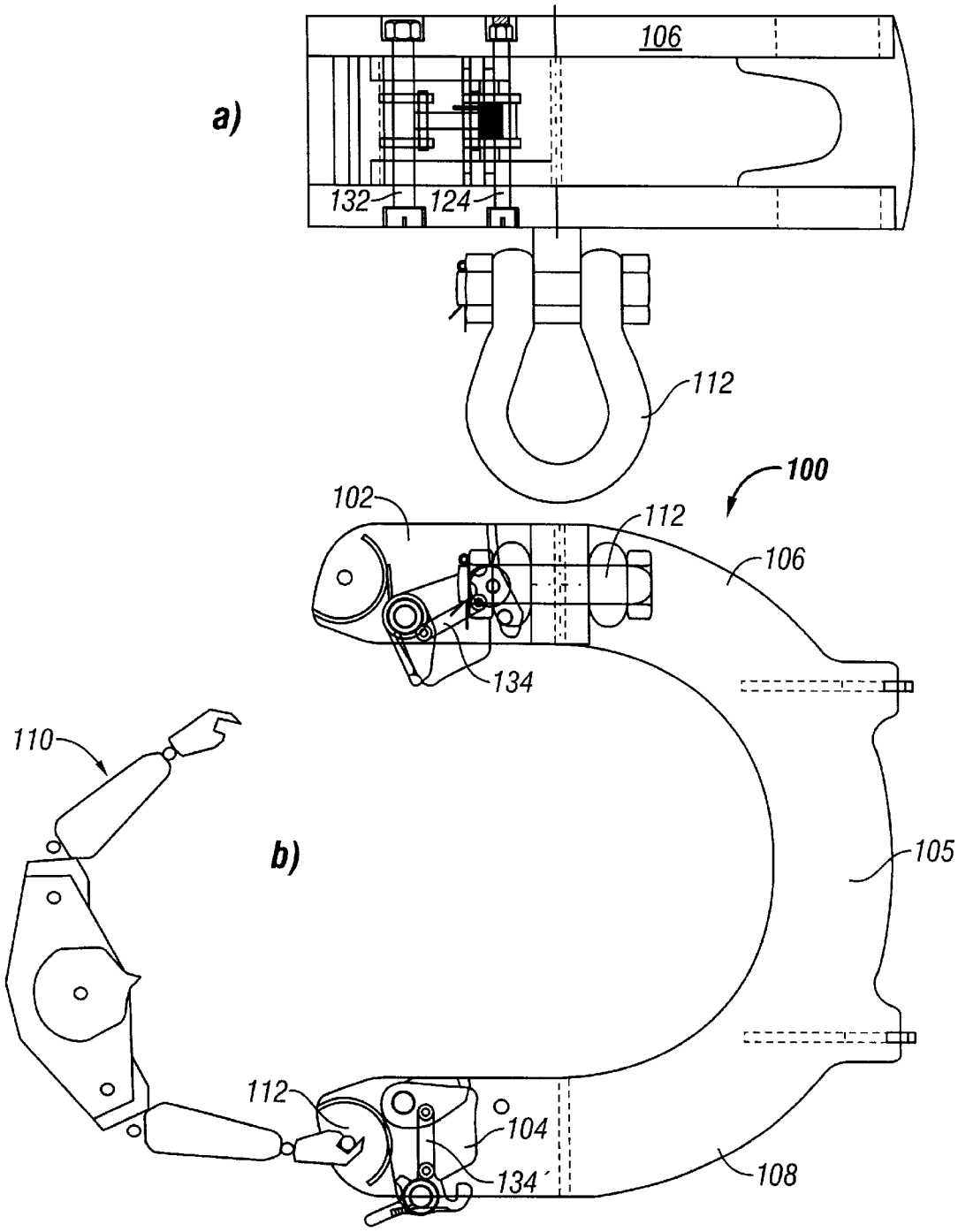
FIG. 3 is a top plan view of the elevator according to the present invention.

Referring now to FIG. 3(*a*), the elevator 100 is illustrated in this preferred mode of the invention as being essentially U-shaped, sometimes referred to as having a horseshoe shape. A first latching mechanism 102 and a second latch mechanism 104 are located, respectively, within the two arms 106 and 108 of the U-shaped elevator 100. The two arms 106 and 108, together with the arcuate end section 105 form the U-shape. A "stick figure" illustration of a human being 110, which typically would be a rig hand working on the derrick in tripping the tubulars in or out, is illustrated as having his right hand on the elevator handle 112. The latch mechanism 104 is illustrated as being in the open position, whereas the latch mechanism 102 is in a closed position, as will be explained in more detail with respect to FIG. 4, hereafter. Although explained in more detail with respect to FIG. 4 and FIG. 5, it should be appreciated that as the pipe or other tubular enters the open end of the horseshoe shaped elevator 100, the tubular will contact the latching mechanisms 102 and 104, causing both of them to assume the open position as shown in FIG. 3 for mechanism 104. As the tubular proceeds further into the interior of the U-shaped elevator 100 the mechanisms 102 and 104 will return to the closed position as illustrated with respect to mechanism 102 of FIG. 3, thus entrapping the tubular within the interior of the elevator 100.

Figure 4:
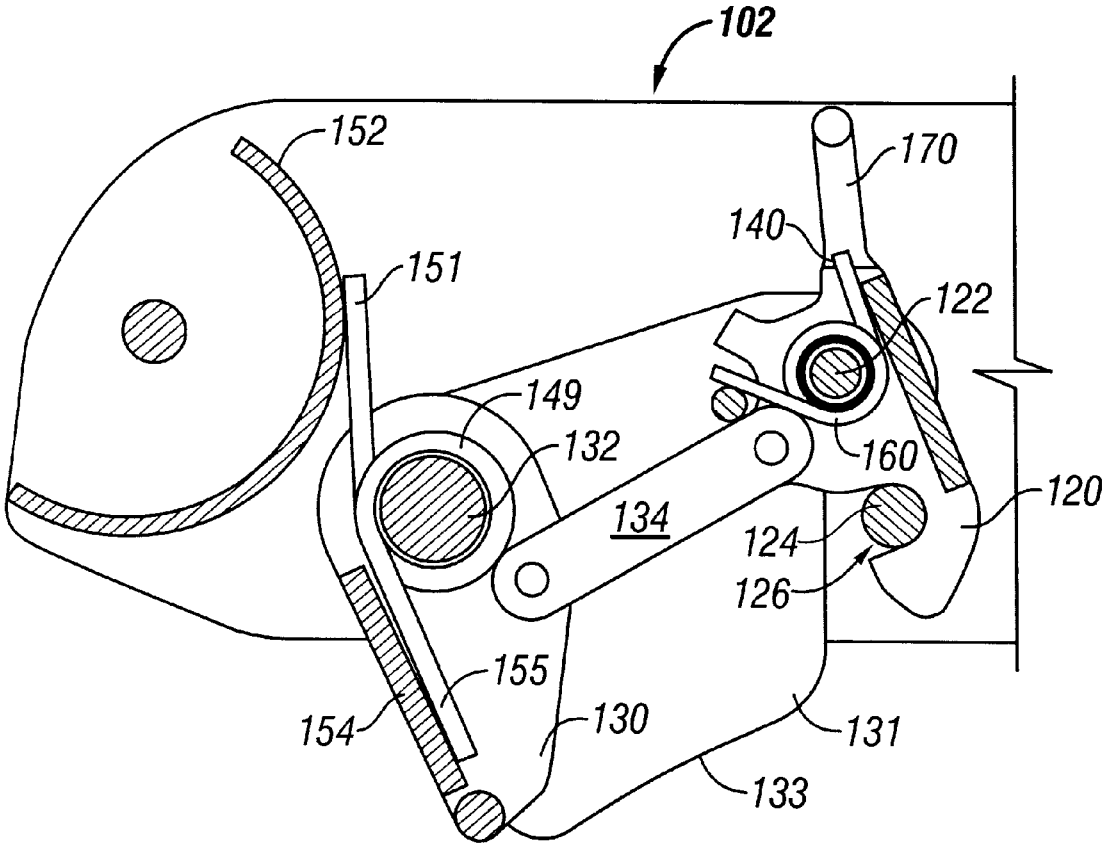
FIG. 4 is an expanded view of a latch mechanism used with the elevator illustrated in FIG. 3 according to the present invention.

Referring now to FIG. 4, the enlarged view of the latch 102 is now described in greater detail. It should be appreciated that the latches 102 and 104 are in cut-outs in the sides of arms 106 and 108, respectively, of the elevator 100, and are not located on the top surface of the elevator 100. The top surface of elevator 100 is sized to be smaller, in its internal diameter, than the external diameter of the upset end of the casing being raised or lowered.

The latch mechanism 102 in FIG. 4 includes a disconnector arm 130 having a wear pad 154 which will be contacted first by the tubular to be entrapped. The arm 130 is pivotable about a pivot rod 132 which, as illustrated in FIG. 3(*b*), traverses the width of arm 106. A spring 149 encircles the pivot rod 132, and has a first end 155 located against the back surface of the wear pad 154, and a second end 151 located against the elevator handle 152 which is used merely to hand position the elevator 100, if and when needed.

A disconnector link 134 has a first end connected to the disconnector arm 130 and a second end connected to a safety latch plate 120. The plate 120 has a recess 126 sized to receive a rod 124, which as illustrated in FIG. 3(*b*), traverses the width of arm 106.

Further in FIG. 4, the plate 126 is illustrated as being pivotable about a rod 122, which has a spring 160 encircling the rod 122 and having a first end located against one end of the disconnector link 134 and a second end connected within a manual handle 170. The handle 170 is illustrated as shorter than its actual length, which may be one to two feet long for case of operation.

The tubular catch 131 is configured from a hard metal, for example, steel, and is thick enough and strong enough to withstand any forces exerted by the entrapped tubular, and has an arcuate lower surface 133 closely approximating the curvature of the entrapped tubular, for example, as illustrated in step 10 of FIG. 5. The catch 131 also pivots around the pivot rod 132, and has a width closely approximating the width of the arm 106.

FIG. 3 also illustrates a bale attachment member 112, one of which is attached to each of the arms 106 and 108, allowing the elevator 100 to be used with a traveling block (not illustrated).

In the operation of the latch mechanism 102 of FIG. 4, the latch is illustrated as being in the closed position, exactly the same position as if a tubular were trapped inside the elevator 100. The latch mechanism 104 of FIG. 3, which is a mirror image of latch mechanism 102, would also be in the closed position. As the tubular to be entrapped within the elevator approaches the elevator, the tubular first contacts the wear pads of the disconnector arms of the two latches 102 and 104, (e.g., wear pad 154 of arm 130 of latch 102).

As insertion continues, the disconnector arms are swung away in an arc-like path and this motion actuates the disconnector links which disengage the safety latches, e.g., plate 120, allowing the pipe catches, e.g. catch 131, freedom to move. The continuing movement of the pipe into the elevator next causes the pipe to contact the pipe catches directly and pushes them out of the way against a nominal spring force. After the pipe is fully seated into the elevator, the pipe catches (no longer restrained by the pipe body) will automatically deploy by means of spring power. The pipe is now mechanically trapped and cannot fall out of the elevator. As a function of the mechanism's geometry, the greater the force from the pipe resting against the catches, the greater will be the resistance to opening. The pipe catches, in effect, become self-energizing. In fact, it will not be possible to manually open the elevator if a side force against the catches is present. This feature is an additional safety benefit.

It should be appreciated that as the tubular to be trapped within the elevator touches the disconnector arm such as arm 130 in FIG. 4, the disconnector link 134 causes the safety latch plate 120 to disengage from the rod 124. As the tubular moves further past the catch 131, the plate 120 swings into position such as is better illustrated for latch mechanism 104 in FIG. 3, which illustrates the disconnector link 134 as being essentially perpendicular to the longitudinal axis of the arm 108. In that position, the latch 104 is in the open position and allows the tubular to be further inserted within the interior of the elevator 100. As the tubular goes past the latch mechanisms 102 and 104, the latch mechanisms 102 and 104 return to their closed position such as is illustrated by the latch mechanism 102 in FIG. 3.

When the tubular which is entrapped within the elevator 100 is in a position which no longer requires the elevator 100 to be used, the handle 170 illustrated in FIG. 4 is rotated manually to return the latch mechanism 102 to its open position. The corresponding handle for latch mechanism 104 is similarly rotated, and with each of the latch mechanisms 102 and 104 in the open position, the elevator 100 is easily removed from the tubular.

Thus, it should be appreciated that in utilizing the apparatus and method herein disclosed, whenever it is desired to attach the elevator according to the invention around a tubular, whenever the tubular is in a horizontal or near horizontal position, the only step required to attach the elevator to the tubular is to drop the elevator, or lower the elevator onto the tubular and the latching mechanisms herein described will entrap the tubular with no additional steps required. Such a method is illustrated by means of the sequential steps of FIG. 5 in which the elevator 100 is lowered onto the horizontal tubular 200. Similarly, if the tubular is in a vertical position, the elevator can be moved into the latching position merely by positioning the elevator up against the tubular and pushing the two elements together i.e., the elevator against the side of the vertical tubular.

Figure 6:
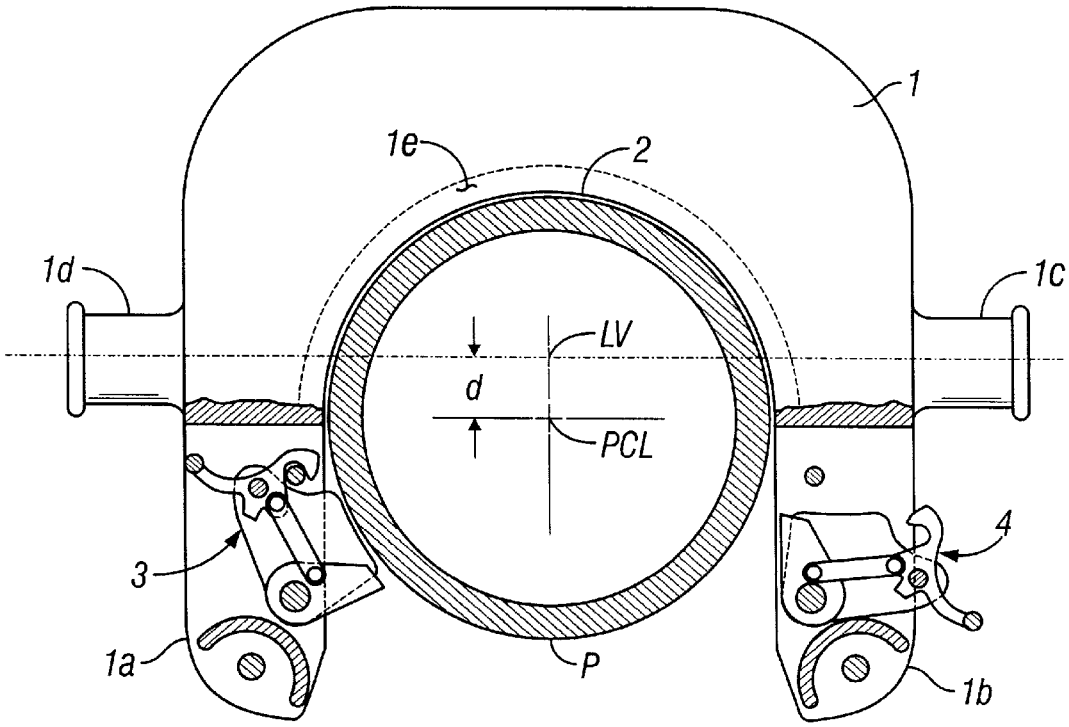
FIG. 6 is a top plan view of an elevator according to the present invention illustrating an additional feature of the invention.
Figure 7:
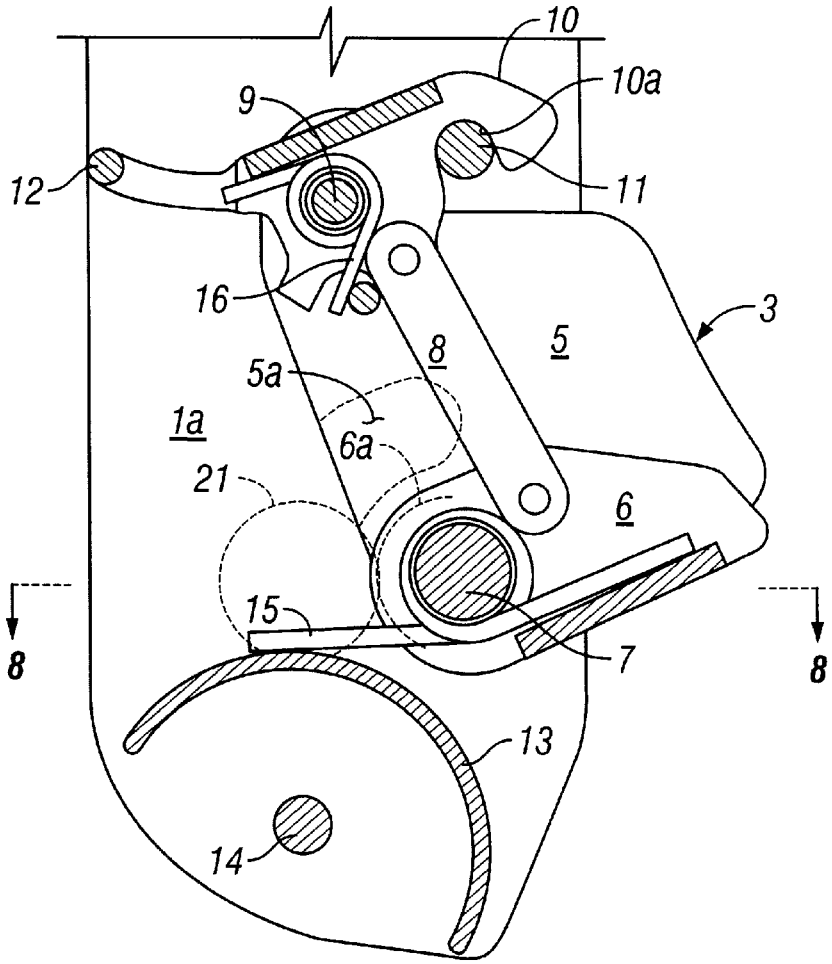
FIG. 7 is an enlarged top view of a portion of the elevator of FIG. 6 illustrating an alternative embodiment of the invention.
Figure 8:
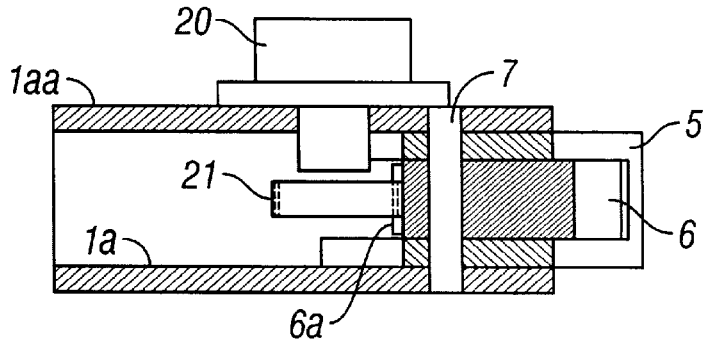
FIG. 8 is a sectional view taken along the section lines 8—8 of FIG. 7.

FIGS. 6, 7 and 8 illustrate some additional features and alternative embodiments of the invention. FIG. 6 shows the U-shaped elevator 1 with a pipe section P in the throat 2. Latch 3 in arm 1*a* is in the closed position to retain the pipe in the throat. Latch 4, in arm 1*b*, is in the open position to allow pipe to move in or out of the throat. Latches 3 and 4 correspond, for the most part, to the latches 102 and 104 previously described herein, both as to structure and as to function.

Ears 1*d* and 1*c* of the elevator 1 are situated such that their centerline passes some distance d toward the throat from the pipe centerline, identified as PCL in FIG. 6. Point LV is the origin of a lift vector when a pipe load is lifted by a pair of bails (not illustrated) which engage the ears 1*d* and 1*c*, respectively. The ears can rotate in the loops of the bails (not shown) which suspend the elevator from the traveling block. When lifted pipe is vertical, the pipe usually has a top coupler with a downwardly facing plane surface that rests on the area 1*e* of FIG. 6. With the area interrupted by the throat gap, the geometric center of the lift area is usually near the lift vector LV. This is an optional feature and the distance d is a design choice influenced by elevator size and the nature of the expected pipe string load.

FIG. 7 illustrates alternative details of latch 3. In arm 1*a*, post 7 bearingly supports rotating members 5 and 6. Member 5 is the blocking member that prevents movement of pipe into and out of the throat. Member 6 is the incoming load sensor lever. When engaged by incoming pipe, lever 6 pivots about post 7, pushes link 8 to rotate member 10 about secondary post 9 to lift recess 10*a* clear of post 11. The blocking member 5 then rotates about post 7. Post 9 is mounted on member 5 and swings with member 5. Posts 11 and 7 are secured within the arms 106 and 108 of the elevator 100 illustrated in FIG. 3.

The access to the throat can be cleared by pulling handle 12 toward the free end of the arm. That action rotates member 10 about secondary post 9 and all elements mounted on member 5 rotate counterclockwise to pull blocking member 5 out of the throat access, to free pipe to move from the throat of the elevator.

Springs 15 and 16 bias the blocking member to the closed state and bias the security lock, element 10 on post 11, to the locked state.

Hand grip 14 is used for manually moving the elevator and glove shield 13 to keep gloves out of the mechanism.

Alternatively, a powered version of the latch mechanism leaves the option of manual manipulation of the latches unencumbered. A motor 20 rotates (see FIG. 3) post 7, as an output shaft of the motor 20. The post 7 is keyed to element 6 and bearingly situated in plates 1*a* and 1*aa* as well as blocking member 5. Motor 20, can be secured to plate 1*aa*, and driving pinion 21, in mesh with gear teeth 6*a* on lever 6, as an alternate arrangement, requiring cutaway 5*a* in one side of the blocking member 5.

The mounting and configuration of driving motor 20 accommodates either fluid powered or electric drive systems. Open center valving serves motor 20, if fluid is used, to facilitate free wheeling of the motor for manual latch operation. The motor 20 can be mounted on either plate 1*a* or plate 1*aa* to project either above or below the elevator.

FIG. 8 shows plates 1*a* and 1*aa*, and only the elements involved in adaptation for motor use of the latching mechanisms described herein. Plates 1*a* and 1*aa* are continuations of the lower and upper surface plates defining the envelope of the body of the elevator which is currently of weldment construction. Current construction practices are not to be construed in a limiting sense.

From the foregoing, it will be seen that this invention is one well adapted to attain all of the ends and objects hereinabove set forth, together with other advantages which are obvious and which are inherent to the elevator described and illustrated herein.

It will be understood that certain features and sub-combinations are of utility and maybe employed without reference to other features and sub-combinations. This is contemplated by and is within the scope of the claims.

As many possible embodiments may be made of the elevator of this invention without departing from the scope thereof, it is to be understood that all matter herein set forth or shown in the accompanying drawings is to be interpreted as illustrative and not in a limiting sense.

While the preferred embodiment of the present invention contemplates the use of an elevator having a U-shape with parallel arms, the arms can either be parallel, or inclined slightly towards each other or even inclined slightly away from each other. Moreover, while the present invention contemplates that a given elevator will have a single pair of latching mechanisms, the elevator according to the present invention could also include two or more pairs of latching mechanisms which could be used to entrap a tubular within the elevator.

What is claimed is:

1. An elevator for lifting and lowering heavyweight oilfield casing, the elevator comprising:

a) a U-shaped body having adjacent arms separated by a throat arranged to accept said oilfield casing;

b) each said arm provided with a throat access blocking member that is arranged such that it responds to force to move to allow said oilfield casing to enter said throat;

c) each said throat access blocking member capable of being independently operable and provided with a security latch that holds the blocking member in the closed state, but is non-responsive to force applied by a length of casing tending to move out of said throat, and remains in said closed state until said security latch is actuated to the release state;

d) release actuating means on each arm arranged such that, when actuated, it releases said security latch.

2. The elevator of claim 1 wherein said release actuating means is a manually movable arrangement.

3. The elevator of claim 1 wherein said release actuating means is a motor driven arrangement with remote controls.

4. The elevator of claim 1 wherein said release means comprises both motor driven and manually movable means, each independently operable.

5. The elevator of claim 1 wherein said release means, when actuated, first releases said security latch, then moves said blocking member to open said throat to release said oilfield tubulars.

6. The elevator of claim 1 wherein each said blocking member has a pivoting axis.

7. An elevator for raising and lowering heavyweight oilfield casing, the elevator comprising:

a) a U-shaped body having first and second adjacent arms separated by a throat arranged to accept heavyweight oilfield casing therein, said first and second arms and said throat defining an interior throat surface against which a length of casing can ride flush while entering and/or exiting said U-shaped body;

b) each arm provided with a one-way throat access blocking member that moves to allow said oilfield casing to enter said throat but is non-responsive to forces applied by a length of casing tending to move out of said throat, each blocking member biased toward closure, and provided with a motion lock biased toward the locked state which immobilizes said blocking member;

c) each said motion lock provided with an entry sensor element that moves to temporarily open said motion lock when pushed by said oilfield casing tending to enter said throat;

d) release actuating means on each arm arranged such that when actuated to release, first releases said motion lock, then moves said blocking member to open said throat to release said oilfield casing, said blocking members each being retractable entirely away from the interior throat surface to allow a length of casing to ride flush against said interior throat surface whenever said casing is entering and/or exiting said U-shaped body.

8. The elevator of claim 7 wherein said release actuating means is a manually movable arrangement.

9. The elevator of claim 7 wherein said actuating means is a motor driven arrangement with remote controls.

10. The elevator of claim 7 wherein said release means comprises both motor driven and manually movable means, each independently operable.

11. The elevator of claim 7 wherein said body has lifting bail attachments providing tilting ability to rotate about a horizontal line to present said throat opening downwardly to engage horizontal pipe sections.

12. The elevator of claim 11 wherein said horizontal line providing an axis around which said bail attachments rotate is displaced toward the back of the throat from the centerline of said oilfield tubular in said throat.

13. The elevator of claim 12 wherein said blocking member has a pivoting axis.

14. An elevator for lifting and lowering heavyweight oilfield casing, the elevator comprising:

a) a U-shaped body having first and second adjacent arms separated by a throat arranged to accept said oilfield casing, said first and second arms and said throat defining an interior throat surface against which a length of casing can ride flushwhile entering and/or exiting said U-shaped body;

b) each said arm provided with a one-way throat access blocking member that is arranged to move such that it responds to force to move to allow said oilfield casing to enter said throat but is non-responsive to force applied by a length of casing tending to move out of said throat;

c) each blocking member provided with a security latch that holds the blocking member in the closed state until said security latch is actuated to the release state; and d) release actuating means on each arm arranged such that when actuated to release, first releases said security latch, then moves said blocking member to open said throat to release said oilfield casing, said blocking members each being retractable entirely away from the interior throat surface to allow a length of casing to ride flush against said interior throat surface whenever said casing is entering and/or exiting said U-shaped body.

15. The elevator of claim 14 wherein said release actuating means is a manually movable arrangement.

16. The elevator of claim 14 wherein said actuating means is a motor driven arrangement with remote controls.

17. The elevator of claim 14 wherein said release means comprises both motor driven and manually movable means, each independently operable.

18. The elevator of claim .herein said body has lifting bail attachments providing tilting ability to rotate about a horizontal line to present said throat opening downwardly to engage horizontal pipe sections.

19. The elevator of claim 18 wherein said horizontal line providing an axis around which said bail attachments rotate is displaced toward the back of the throat from the centerline of said oilfield tubular in said throat.

20. The elevator of claim 14 wherein said blocking member has a pivoting axis.

21. An elevator for lifting and lowering heavyweight oilfield casing, the elevator comprising:

a) a U-shaped body having adjacent arms separated by a throat arranged to accept said oilfield casing;

b) each said arm provided with a one-way blocking member that is arranged to move such that it responds to force to move to allow said oilfield casing to enter said throat but is non-responsive to force applied by a length of casing tending to move out of said throat;

c) each blocking member provided with a security latch that holds the blocking member in the closed state until said security latch is actuated to the release state.

d) release actuating means on each arm arranged such that when actuated to release, first releases said security latch, then moves said blocking member to open said throat to release said oilfield casing; and e) attachment means on said body for lifting the elevator, and the associated casing load, that allows said body to rotate about an axis to direct the throat downward, said axis arranged to be a selected distance, toward the back of said throat, from the centerline of said oilfield casing when in said throat.

22. The elevator of claim 21 wherein said release actuating means is a manually operable arrangement.

23. The elevator of claim 21 wherein said actuating means is a motor driven arrangement with remote controls.

24. The elevator of claim 21 wherein said release means comprises both motor driven and manually operable means, each independently operable.

25. The elevator of claim 21 wherein said release means, when actuated, first releases said security latch, then moves said blocking member to open said throat to release said oilfield tubulars.

26. The elevator of claim 21 wherein said body has a flat area on the top of said body to engage, for lifting an assembled well string, a lower plane surface of a coupler.

27. The elevator of claim 26 wherein said blocking member has a pivoting axis and is non-responsive to force applied by said oilfield tubulars tending to move out of said throat as a result of location of the pivoting axis relative to the direction of said force.

28. An improved elevator for lifting and lowering heavyweight oilfield casing, comprising:

a) a U-shaped elevator body having an end portion and first and second arms extending from said end portion, said first and second arms being separated by a distance larger than the primary outside diameter of the casing to be lifted and/or lowered;

b) a first latching mechanism carried by said first arm;

c) a second latching mechanism carried by said second arm, each of said first and second latching members being operable independently from each other, each of said latching mechanisms having an open position and a closed position, and each of said latching mechanisms being structured such that said latching mechanisms move to an open position responsive to contact by a length of casing and return to a closed position responsive to said casing being positioned within said elevator body, wherein said first and second latching members are each structured to comprise a first, primary locking mechanism and a second safety locking mechanism and further structured such that the casing can be released from the elevator only in response to the rotation of manually operated first and second override handles associated with said first and second latching members, respectively.

29. The elevator according to claim 28, wherein said first and second arms are parallel.

30. The elevator according to claim 28, including in additional thereto, first and second bail attachment members connected to said first and second arms, respectively.

31. An improved elevator for lifting and lowering heavyweight oilfield casing, comprising:

a) a U-shaped body having an end portion and first and second arms extending from said end portion, said first and second arms being separated by a distance larger than the primary outside diameter of the casing to be lifted and/or lowered;

b) a first latching mechanism carried by said first arm;

c) a second latching mechanism carried by said second arm, each of said latching mechanisms having an open position and a closed position, and each of said latching mechanisms being structured such that said latching mechanisms move to an open position responsive to contact by a length of casing and return to a closed position responsive to said casing no longer being in contact with said latching mechanisms, each of said first and second latching members capable of being operable independent of each other, wherein said first and second latching members are each structured to comprise a first, primary locking mechanism and a second safety locking mechanism and further structured such that the casing can be released from the elevator only in response to the rotation of manually operated first and second override handles associated with said first and second latching members, respectively.

32. A method for entrapping and releasing a length of heavyweight oilfield casing within an elevator, comprising the steps of:

positioning said elevator, carrying first and second latching members which can function independently of each other, above a length of heavyweight oilfield casing; lowering said elevator over said casing to thereby entrap said casing within said elevator using said latching members; and releasing the entrapment of said casing only by rotating first and second handles associated, respectively, with said first and second latching members carried by said elevator.

33. The method according to claim 32, including the additional step of lifting said elevator with said tubular entrapped therein.

34. The method according to claim 32, wherein said tubular is positioned other than vertically prior to said elevator being lowered over said tubular.

35. The method according to claim 34, wherein said tubular is positioned horizontally prior to said elevator being lowered over said tubular.

36. A method for entrapping and releasing a heavyweight oilfield casing within an elevator, comprising the steps of:

positioning an elevator, carrying first and second latching members which function independently of each other, beside a length of heavyweight oilfield casing; entrapping said casing within said elevator by pushing the elevator and the casing into latching engagement with each other; and releasing the entrapment of said casing by rotating first and second handles associated, respectively, with first and second latching members carried by said elevator.

37. The method according to claims, wherein the tubular is vertical prior to the elevator and the tubular being pushed into latching engagement.

38. An elevator for raising and lowering heavyweight oilfield tubulars, the elevator comprising:

a) a U-shaped body having first and second adjacent arms separated by a throat arranged to accept heavyweight oilfield tubulars therein, said first and second arms and said throat defining an interior throat surface against which a tubular can ride flush while entering and/or exiting said U-shaped body;

b) said first and second arms provided with first and second one-way throat access blocking members, respectively, that move to allow said oilfield tubulars to enter said throat but are non-responsive to forces applied by a tubular tending to move out of said throat, each said blocking member being biased toward closure, said first and second blocking members each being retractable entirely away from the interior throat surface to allow a tubular to ride flush against said interior throat surface whenever said tubular is entering and/or exiting said U-shaped body.

39. An elevator for raising and lowering heavyweight oilfield tubulars, the elevator comprising:

a) a U-shaped body having first and second parallel arms separated by a semi-circular throat arranged to accept oilfield tubulars therein, said first and second arms and said throat defining an interior throat surface against which a tubular can ride while entering and/or exiting said U-shaped body, said U-shaped body having a first longitudinal axis parallel to said first and second arms and a second axis perpendicular to said first parallel axis, said second axis passing through the mid-point of said throat if an imaginary extension of said throat were a fill circle;

b) first and second lifting bail attachments connected to said U-shaped body along a third axis parallel to said second axis, but displaced from said second axis towards the back of said throat.

40. An elevator for raising and lowering heavyweight oilfield tubulars, the elevator comprising:

a) a U-shaped body having first and second arms separated by a throat arranged to accept heavyweight oilfield tubulars therein, said first and second arms and said throat defining an interior throat surface against which a tubular can ride while entering and/or exiting said U-shaped body; and b) first and second lifting bail attachments connected to said U-shaped body along a first axis perpendicular to the second longitudinal axis of said U-shaped body, wherein said first axis is displaced towards the back of said throat from the centerline of any heavyweight tubular accepted by said throat.

41. A method for entrapping and releasing a heavyweight oilfield casing within an elevator, comprising the steps of:

positioning said elevator, carrying first and second latching members which function independently of each other, above a length of heavyweight oilfield casing; lowering said elevator over said casing to thereby entrap said casing within said elevator using said latches; and releasing the entrapment of said casing by said latching members.

42. A method for entrapping and releasing a heavyweight oilfield casing within an elevator, comprising the steps of:

positioning an elevator, carrying first and second latching members which function independently of each other, beside a heavyweight oilfield casing; entrapping said casing within said elevator by pushing the elevator and the casing into latching engagement with each other; and releasing the entrapment of said casing by said latching members.

43. An improved elevator for lifting and lowering heavyweight oilfield casing, comprising:

a) a U-shaped elevator body having an end portion and first and second arms extending from said end portion, said first and second arms being separated by a distance larger than the primary outside diameter of the casing to be lifted and/or lowered;

b) a first latching mechanism carried by said first arm;

c) a second latching mechanism carried by said second arm, each of said first and second latching members being operable independently of each other, each of said latching mechanisms having an open position and a closed position, and each of said latching mechanisms being structured such that said latching mechanisms move to an open position responsive to contact by a length of casing and return to a closed position responsive to said casing being positioned within said elevator body, wherein said first and second latching members are each structured to comprise a first, primary locking mechanism and a second safety locking mechanism and further structured such that the casing can be released from the elevator.

44. A method for entrapping and releasing a length of heavyweight oilfield casing from within an elevator, comprising the steps of:

positioning said elevator having at least one latching member carried by said elevator which can be manipulated completely out of the path of the said length of heavyweight casing, above a length of heavyweight oilfield casing; lowering said elevator over said casing to thereby entrap said casing within said elevator using said at least one latching member and releasing the entrapment of said casing by using at least one motor to release said at least one latching member completely out of the path of the said length of heavy weight casing.

45. The method according to claim 44, wherein the said at least one motor is driven by an electrical system.

46. The method according to claim 44, wherein the said at least one motor is driven by a fluid system.

47. A method for entrapping and releasing a length of heavyweight oilfield casing from within an elevator, comprising the steps of:

positioning an elevator having at least one latching member carried by said elevator which can be manipulated completely out of the path of the said length of heavyweight casing, beside a length of heavyweight oilfield casing; entrapping said casing within said elevator by pushing the elevator and the said length of casing into engagement with each other; and releasing the entrapment of said length of casing by using at least one motor to release said at least one latching member completely out of the path of the said length of heavyweight oilfield casing.

48. The method according to claim 47, wherein the said at least one motor is driven by an electrical system.

49. The method according to claim 47, wherein the said at least one motor is driven by a fluid system.

* * * * *